US009285153B2

(12) United States Patent
Contreras Lafaire et al.

(10) Patent No.: US 9,285,153 B2
(45) Date of Patent: Mar. 15, 2016

(54) HIGH PERFORMANCE REFRIGERATOR HAVING PASSIVE SUBLIMATION DEFROST OF EVAPORATOR

(71) Applicant: Thermo Fisher Scientific (Asheville) LLC, Asheville, NC (US)

(72) Inventors: J. Antonio Contreras Lafaire, Fletcher, NC (US); Ralph Hegedus, Candler, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 481 days.

(21) Appl. No.: 13/653,448

(22) Filed: Oct. 17, 2012

(65) Prior Publication Data

US 2013/0098078 A1 Apr. 25, 2013

Related U.S. Application Data

(60) Provisional application No. 61/548,816, filed on Oct. 19, 2011.

(51) Int. Cl.
*F25D 21/06* (2006.01)
*F25B 5/02* (2006.01)
(Continued)

(52) U.S. Cl.
CPC . *F25D 21/06* (2013.01); *F25B 5/02* (2013.01); *F25B 2400/0409* (2013.01); *F25B 2600/2511* (2013.01); *F25D 17/045* (2013.01); *F25D 21/08* (2013.01); *F25D 21/12* (2013.01)

(58) Field of Classification Search
USPC ..... 62/151
See application file for complete search history.

(56) References Cited

U.S. PATENT DOCUMENTS 2,330,913 A 10/1943 Philipp
2,758,150 A 8/1956 Zargarpur
(Continued)

FOREIGN PATENT DOCUMENTS

CN 85109092 A 8/1986
CN 1167243 A 12/1997
(Continued)

OTHER PUBLICATIONS

Great Britian Intellectual Property Office, Examination Report under Section 18(3) issued in copending Great Britian Patent Application No. 1218351.3 (May 21, 2014) (1 page).
(Continued)

*Primary Examiner* — M. Alexandra Elve
*Assistant Examiner* — Larry Furdge
(74) *Attorney, Agent, or Firm* — Wood, Herron & Evans, LLP

(57) ABSTRACT

A high performance refrigerator or freezer includes a cabinet with a refrigerated interior, a first evaporator cover separating a first evaporator compartment within the cabinet from the refrigerated interior, and a refrigeration fluid circuit having a first evaporator located within the first evaporator compartment, a second evaporator, and a three-way valve enabling selective communication of refrigerant to one or both of the evaporators. The second evaporator includes an air diffuser that receives chilled air from the first evaporator compartment and delivers the chilled air into the refrigerated interior. During normal operation, the three-way valve only directs refrigerant into the first evaporator such that the first evaporator cools the cabinet and the chilled air from the first evaporator passively defrosts the second evaporator by sublimation.

18 Claims, 6 Drawing Sheets

(51) Int. Cl.

| | |
|---|---|
| *F25D 21/08* | (2006.01) |
| *F25D 17/04* | (2006.01) |
| *F25D 21/12* | (2006.01) |

(56) References Cited

U.S. PATENT DOCUMENTS

| | | | | |
|---|---|---|---|---|
| 2,769,319 | A | 11/1956 | Alsing | |
| 2,807,149 | A | 9/1957 | Williams, Jr. | |
| 2,876,630 | A | 3/1959 | Boling | |
| 3,022,639 | A | 2/1962 | Brown et al. | |
| 3,070,973 | A | 1/1963 | O'Connell | |
| 3,156,102 | A | 11/1964 | Costantini et al. | |
| 3,381,494 | A | 5/1968 | Steelman | |
| 3,537,274 | A | 11/1970 | Tilney | |
| 3,733,841 | A | 5/1973 | Gelbard | |
| 3,784,785 | A | 1/1974 | Noland | |
| 3,875,758 | A | 4/1975 | Fischer | |
| 4,122,687 | A * | 10/1978 | McKee | 62/156 |
| 4,270,364 | A | 6/1981 | Oonishi et al. | |
| 4,474,026 | A | 10/1984 | Mochizuki et al. | |
| 4,513,581 | A | 4/1985 | Mizobuchi et al. | |
| 4,537,041 | A * | 8/1985 | Denpou et al. | 62/199 |
| 4,633,677 | A | 1/1987 | Maehara | |
| 4,691,527 | A | 9/1987 | Ikeda | |
| 4,920,764 | A | 5/1990 | Martin | |
| 4,928,501 | A | 5/1990 | Negishi | |
| 4,945,732 | A | 8/1990 | Haruyama et al. | |
| 4,964,281 | A | 10/1990 | Tanaka | |
| 4,976,116 | A * | 12/1990 | Hayama et al. | 62/441 |
| 5,082,335 | A | 1/1992 | Cur et al. | |
| 5,157,943 | A | 10/1992 | Jaster et al. | |
| 5,220,807 | A | 6/1993 | Bourne et al. | |
| 5,228,308 | A | 7/1993 | Day et al. | |
| 5,255,536 | A | 10/1993 | Jung et al. | |
| 5,285,652 | A | 2/1994 | Day | |
| 5,309,725 | A | 5/1994 | Cayce | |
| 5,315,835 | A | 5/1994 | Park | |
| 5,402,656 | A * | 4/1995 | Jaster et al. | 62/515 |
| 5,406,805 | A | 4/1995 | Radermacher et al. | |
| 5,460,010 | A | 10/1995 | Kobayashi et al. | |
| 5,531,078 | A | 7/1996 | Day et al. | |
| 5,694,782 | A | 12/1997 | Alsenz | |
| 5,735,131 | A | 4/1998 | Lambright, Jr. et al. | |
| 5,758,510 | A | 6/1998 | Cho | |
| 5,816,054 | A | 10/1998 | Yoo et al. | |
| 5,826,438 | A | 10/1998 | Ohishi et al. | |
| 5,832,738 | A | 11/1998 | Shin | |
| 5,887,440 | A | 3/1999 | Dube | |
| 5,901,570 | A | 5/1999 | Sin | |
| 5,987,904 | A | 11/1999 | Kim et al. | |
| 6,000,231 | A | 12/1999 | Alsenz | |
| 6,105,387 | A | 8/2000 | Hong et al. | |
| 6,253,561 | B1 | 7/2001 | Imakubo | |
| 6,318,107 | B1 | 11/2001 | Pandaru et al. | |
| 6,370,895 | B1 | 4/2002 | Sakuma et al. | |
| 6,370,908 | B1 | 4/2002 | James | |
| 6,385,983 | B1 | 5/2002 | Sakki et al. | |
| 6,389,833 | B1 | 5/2002 | Bouloy | |
| 6,418,741 | B1 | 7/2002 | Nungesser et al. | |
| 6,427,463 | B1 | 8/2002 | James | |
| 6,490,878 | B1 | 12/2002 | Luminet et al. | |
| 6,543,245 | B1 | 4/2003 | Waldschmidt et al. | |
| 6,578,376 | B2 | 6/2003 | Thurman | |
| 6,609,390 | B1 | 8/2003 | Ueno et al. | |
| 6,622,498 | B2 | 9/2003 | Park et al. | |
| 6,655,170 | B2 | 12/2003 | Holz et al. | |
| 6,691,527 | B2 | 2/2004 | Bureau et al. | |
| 6,715,305 | B2 | 4/2004 | Doi et al. | |
| 6,739,146 | B1 * | 5/2004 | Davis et al. | 62/155 |
| 6,775,998 | B2 | 8/2004 | Yuasa et al. | |
| 6,786,056 | B2 | 9/2004 | Bash et al. | |
| 6,923,014 | B2 | 8/2005 | Goth et al. | |
| 7,051,539 | B2 | 5/2006 | Jung et al. | |
| 7,137,266 | B2 | 11/2006 | Kim et al. | |
| 7,213,407 | B2 | 5/2007 | Hu | |
| 7,367,200 | B2 | 5/2008 | Ikegami et al. | |
| 7,448,226 | B2 | 11/2008 | Yamashita et al. | |
| 7,461,515 | B2 | 12/2008 | Wellman | |
| 7,506,520 | B2 | 3/2009 | Oh | |
| 7,610,766 | B2 | 11/2009 | Dube | |
| 7,614,249 | B2 | 11/2009 | Hu | |
| 7,698,902 | B2 | 4/2010 | Kang et al. | |
| 7,703,298 | B2 | 4/2010 | Lee et al. | |
| 7,739,881 | B2 | 6/2010 | Matsunaga et al. | |
| 7,757,514 | B2 | 7/2010 | Oshitani et al. | |
| 7,997,331 | B2 | 8/2011 | Oomura et al. | |
| 8,104,306 | B1 | 1/2012 | Elsner | |
| 8,341,970 | B2 | 1/2013 | Ouchi et al. | |
| 8,459,049 | B2 | 6/2013 | Li | |
| 8,511,102 | B2 | 8/2013 | Feng et al. | |
| 8,511,109 | B2 | 8/2013 | Kuehl et al. | |
| 2002/0184900 | A1 | 12/2002 | Wellman | |
| 2003/0163999 | A1 | 9/2003 | Bennett et al. | |
| 2004/0107727 | A1 | 6/2004 | Kim et al. | |
| 2004/0139763 | A1 | 7/2004 | Jeong et al. | |
| 2005/0039472 | A1 | 2/2005 | Cushman et al. | |
| 2005/0086965 | A1 | 4/2005 | Lalumiere et al. | |
| 2005/0126198 | A1 | 6/2005 | Marchand et al. | |
| 2006/0117768 | A1 | 6/2006 | Lee et al. | |
| 2007/0000271 | A1 | 1/2007 | Lee et al. | |
| 2007/0033962 | A1 | 2/2007 | Kang et al. | |
| 2007/0074524 | A1 | 4/2007 | Tupis et al. | |
| 2008/0016889 | A1 * | 1/2008 | Jung | 62/187 |
| 2008/0104973 | A1 | 5/2008 | Hall et al. | |
| 2008/0148745 | A1 * | 6/2008 | Zhang et al. | 62/113 |
| 2008/0156034 | A1 | 7/2008 | Cur et al. | |
| 2008/0196866 | A1 | 8/2008 | Wu et al. | |
| 2008/0314054 | A1 | 12/2008 | An et al. | |
| 2009/0019881 | A1 | 1/2009 | Rafalovich et al. | |
| 2009/0113923 | A1 * | 5/2009 | Young | 62/441 |
| 2009/0133432 | A1 * | 5/2009 | Lee et al. | 62/441 |
| 2009/0133436 | A1 | 5/2009 | Boiarski et al. | |
| 2009/0173092 | A1 | 7/2009 | Hu | |
| 2009/0199586 | A1 | 8/2009 | Soysal et al. | |
| 2009/0217684 | A1 | 9/2009 | Ouchi et al. | |
| 2010/0011801 | A1 | 1/2010 | Ritchie et al. | |
| 2010/0100243 | A1 | 4/2010 | Lee et al. | |
| 2010/0126200 | A1 | 5/2010 | Oh et al. | |
| 2010/0139300 | A1 | 6/2010 | Jeong et al. | |
| 2010/0139309 | A1 | 6/2010 | Kim et al. | |
| 2010/0192609 | A1 | 8/2010 | Chae et al. | |
| 2010/0192617 | A1 | 8/2010 | Chae et al. | |
| 2010/0205984 | A1 | 8/2010 | Gu et al. | |
| 2010/0242505 | A1 | 9/2010 | Thybo et al. | |
| 2010/0287961 | A1 | 11/2010 | Song et al. | |
| 2010/0300137 | A1 | 12/2010 | Lim et al. | |
| 2010/0326116 | A1 | 12/2010 | Kwon | |
| 2011/0011104 | A1 | 1/2011 | Lesage et al. | |
| 2011/0011109 | A1 | 1/2011 | Rafalovich et al. | |
| 2011/0011119 | A1 | 1/2011 | Kuehl et al. | |
| 2011/0041525 | A1 | 2/2011 | Kim et al. | |
| 2011/0209490 | A1 | 9/2011 | Mijanovic et al. | |
| 2011/0315783 | A1 | 12/2011 | Baker et al. | |
| 2012/0011884 | A1 | 1/2012 | Cho et al. | |
| 2012/0174604 | A1 | 7/2012 | Thogersen et al. | |
| 2013/0055742 | A1 | 3/2013 | Ouchi et al. | |
| 2013/0186129 | A1 | 7/2013 | Bae et al. | |

FOREIGN PATENT DOCUMENTS

| | | | |
|---|---|---|---|
| CN | 1204037 | A | 1/1999 |
| CN | 1289033 | A | 3/2001 |
| CN | 1453540 | A | 11/2003 |
| CN | 101151496 | A | 3/2008 |
| CN | 201066224 | Y | 5/2008 |
| CN | 101435647 | A | 5/2009 |
| CN | 101520272 | A | 9/2009 |
| CN | 101571339 | A | 11/2009 |
| CN | 101619916 | A | 1/2010 |
| CN | 201427542 | Y | 3/2010 |
| CN | 101934755 | A | 1/2011 |
| DE | 4305476 | A1 | 8/1993 |
| DE | 202005021335 | U1 | 8/2007 |
| DK | 165650 | B | 12/1992 |

(56) References Cited

FOREIGN PATENT DOCUMENTS

| | | | |
|---|---|---|---|
| EP | 0541172 | A2 | 5/1993 |
| EP | 0687873 | A2 | 12/1995 |
| EP | 0696893 | A1 | 2/1996 |
| EP | 1628108 | A2 | 2/2006 |
| GB | 2164133 | A | 3/1986 |
| GB | 2496948 | B | 10/2014 |
| JP | 52-131244 | A | 11/1977 |
| JP | 09-210536 | A | 8/1997 |
| JP | H09210536 | A | 8/1997 |
| JP | 2002031466 | A | 1/2002 |
| SE | 463381 | B | 11/1990 |
| WO | 2006104936 | A2 | 10/2006 |
| WO | 2010/087572 | A2 | 8/2010 |

OTHER PUBLICATIONS

Great Britian Intellectual Property Office, Certificate of Grant of Patent issued in copending Great Britian Patent Application No. 1218351.3 (Oct. 15, 2014) (2 pages).

United Kingdom Intellectual Property Office, Patents Act 1977: Combined Search and Examination Report dated Mar. 21, 2013, for corresponding International Patent Application No. GB1218351.3 (7 pages).

United Kingdom Intellectual Property Office, Patents Act 1977: Combined Search and Examination Report dated Mar. 21, 2013, for corresponding International Patent Application No. GB1218364.6 (7 pages).

United Kingdom Intellectual Property Office, Patents Act 1977: Combined Search and Examination Report dated Mar. 21, 2013, for corresponding International Patent Application No. GB1218348.9 (7 pages).

Chinese Patent Office, First Office Action in CN Application No. 201210399155.8, Oct. 31, 2014 (3 pages).

Chinese Patent Office, First Office Action and Search Report in CN Application No. 201210398635.2, Nov. 2, 2014 (11 pages).

Chinese Patent Office, English Translation of the First Office Action in CN Application No. 201210399155.8, Oct. 31, 2014 (2 pages).

Chinese Patent Office, English Translation of the First Office Action and Search Report in CN Application No. 201210398635.2, Nov. 2, 2014 (10 pages).

Chinese Patent Office, First Office Action in CN Application No. 201210400955.7, Jan. 6, 2015, and English language translation thereof.

United States Patent and Trademark Office, Office Action in copending U.S. Appl. No. 13/652,979 (Jan. 16, 2015) (27 pages).

United States Patent and Trademark Office, Office Action in copending U.S. Appl. No. 13/652,968 (Jan. 27, 2015) (22 pages).

United States Patent and Trademark Office, Office Action in copending U.S. Appl. No. 13/652,992 (Feb. 12, 2015) (24 pages).

United States Patent and Trademark Office, Office Action in copending U.S. Appl. No. 13/652,951 (Feb. 13, 2015) (14 pages).

Chinese Patent Office, Second Office Action in CN Application No. 201210398635.2, May 6, 2015, and English language translation thereof.

Chinese Patent Office, Second Office Action in CN Application No. 201210399155.8, May 11, 2015, and English language translation thereof.

United States Patent and Trademark Office, Final Office Action in copending U.S. Appl. No. 13/652,968 Jul. 6, 2015) (32 pages).

* cited by examiner

HIGH PERFORMANCE REFRIGERATOR HAVING PASSIVE SUBLIMATION DEFROST OF EVAPORATOR

CROSS-REFERENCE TO RELATED APPLICATION

The present application claims the priority benefit of U.S. Provisional Patent Application No. 61/548,816 (pending), filed Oct. 19, 2011, the disclosure of which is hereby incorporated by reference in its entirety herein.

FIELD OF THE INVENTION

The present invention relates generally to refrigerators or freezers and, more particularly, to refrigeration systems for use with high performance blood bank refrigerators or plasma freezers.

BACKGROUND OF THE INVENTION

Refrigeration systems are known for use with laboratory refrigerators and freezers of the type known as "high performance refrigerators," which are used to cool their interior storage spaces to relative low temperatures such as about −30° C. or lower, for example. These high performance refrigerators are used to store blood and/or plasma, in one example.

Known refrigeration systems of this type include a single loop circulating a refrigerant. The system transfers energy (i.e., heat) from the refrigerant to the surrounding environment through a condenser, and the system transfers heat energy to the refrigerant from the cooled space (e.g., a cabinet interior) through an evaporator. The refrigerant is selected to vaporize and condense at a selected temperature close to the desired temperature for the cooled space, such that the refrigeration system can maintain the cooled space near that selected temperature during operation.

One common problem with known refrigeration systems is that the evaporator includes coils that tend to produce and accumulate frost along the outer surface if any moisture is ambient within the cooled space. If enough frost accumulation occurs, the ability of the evaporator to remove heat from the cooled space is detrimentally impacted. Consequently, known refrigeration systems require a defrost cycle where the evaporator coils are heated to remove the frost. This defrost cycle may be a manual defrost or an automatic defrost, but both types of defrost cycles are undesirable for various reasons.

In a manual defrost cycle, all of the products stored in the cabinet are removed and the cooled space is left exposed to the ambient environment to heat up the evaporator coils and melt the frost. This cycle is undesirable because the products stored in the cabinet need to be stored in an alternative refrigerator for the duration of the defrost cycle, and also because the melting process can produce a significant amount of moisture that needs to be removed from the cabinet. In an automatic defrost cycle, the evaporator coils are rapidly heated by a local heating unit or hot gas flow to remove the frost, which is collected by a trough and delivered out of the cooled space. The cooled space necessarily undergoes a temperature spike during this automatic defrost cycle, which can jeopardize the products stored in the cabinet.

There is a need, therefore, for a refrigerator that substantially minimizes or eliminates a temperature spike within the cooled space during a defrost cycle.

SUMMARY OF THE INVENTION

In one embodiment, a refrigerator includes a cabinet with a refrigerated interior and a refrigeration fluid circuit for circulating a refrigerant. The refrigeration fluid circuit includes a compressor, a condenser, a first evaporator located within the cabinet, a second evaporator located within the cabinet, an evaporator fan producing air flow through at least one of the first and second evaporators, and a three-way valve enabling selective communication of refrigerant to one or both of the first and second evaporators. The first evaporator includes a first evaporator coil and a first defrost heater. The refrigerator also includes a first evaporator cover separating a first evaporator compartment containing the first evaporator from the refrigerated interior. The second evaporator includes an air diffuser configured to receive chilled air from the first evaporator compartment and to pass the chilled air to the refrigerated interior. The refrigerator also includes at least one damper which opens to permit air circulation from the refrigerated interior through the first evaporator. During normal operation, the three-way valve directs refrigerant into only the first evaporator such that chilled air generated from the first evaporator passively defrosts the second evaporator by sublimation.

The refrigerator further includes a controller operable to command the refrigerator to perform a series of steps defining a defrost cycle when the first evaporator requires defrosting. The series of steps includes directing refrigerant with the three-way valve through only the second evaporator, removing heat from the refrigerated interior with the second evaporator, closing the at least one damper to thermally isolate the first evaporator from the refrigerated interior, and starting operation of the first defrost heater. The refrigerated interior remains thermally isolated from the evaporator during operation of the defrost heater.

In one aspect, the refrigerator also includes a temperature sensor for detecting the temperature of the first evaporator. The controller operates during defrosting as follows: when the temperature sensor detects that the first evaporator has reached a first target temperature above the freezing point of water, the defrost heater stops. After any remaining moisture drips off the evaporator coil, the three-way valve directs refrigerant into both the first and second evaporators. When the temperature sensor detects that the first evaporator has reached a second target temperature below the freezing point of water, the at least one damper opens. In one example, the first target temperature is about 10° C. and the second target temperature is about −25° C. The controller may also be operable to perform the defrost cycle steps as an adaptive defrost cycle, which includes varying time periods between defrost cycles and varying lengths of defrost cycles dependent upon multiple operating parameters.

In one aspect, the second evaporator is a plate shaped or foil type evaporator. In another aspect, the second evaporator is a cold wall tube-type or roll bond type evaporator. The first and second evaporators may cool the refrigerated interior simultaneously during an initial cooling or immediately after the door of the cabinet is opened to reduce the recovery time. The at least one damper may include a first damper that opens to enable air flow into the first evaporator compartment from the refrigerated interior, and a second damper that opens to enable air flow out of the first evaporator compartment and into a second evaporator compartment defined by the air diffuser. The second evaporator compartment includes air inlets that may be blocked by the second damper when in the opened position such that the evaporator fan is forced to draw air through the first and second evaporator compartments.

The evaporator fan in some embodiments is located downstream from the second damper such that the evaporator fan still draws air flow through the second evaporator compartment when the first and second dampers are closed.

In another embodiment of the invention, a method of operating a refrigerator is provided, the refrigerator including a cabinet with a refrigerated interior and a refrigeration fluid circuit. The refrigeration fluid circuit includes a compressor, a condenser, a first evaporator located within the cabinet, a second evaporator located within the cabinet, an evaporator fan, and a three-way valve enabling selective communication between the compressor and one or both of the first and second evaporators. The second evaporator includes an air diffuser. The refrigerator also includes at least one damper selectively permitting air flow between the evaporator from the refrigerated interior. The method includes directing refrigerant only through the first evaporator during normal operation, removing heat from the refrigerated interior with the first evaporator, and passively defrosting the second evaporator by sublimation with chilled air directed from the first evaporator through the air diffuser.

In one aspect, the first evaporator includes a first defrost heater, and the method includes the following series of steps when the first evaporator requires defrosting. The series of steps includes directing refrigerant with the three-way valve only through the second evaporator, removing heat from the refrigerated interior with the second evaporator, closing the at least one damper to isolate the first evaporator from the refrigerated interior, and starting operation of the first defrost heater.

BRIEF DESCRIPTION OF THE DRAWINGS

The accompanying drawings, which are incorporated in and constitute a part of this specification, illustrate an embodiment of the invention and, together with a general description of the invention given above, and the detailed description of the embodiment given below, serve to explain the principles of the invention.

DETAILED DESCRIPTION

Figure 1:
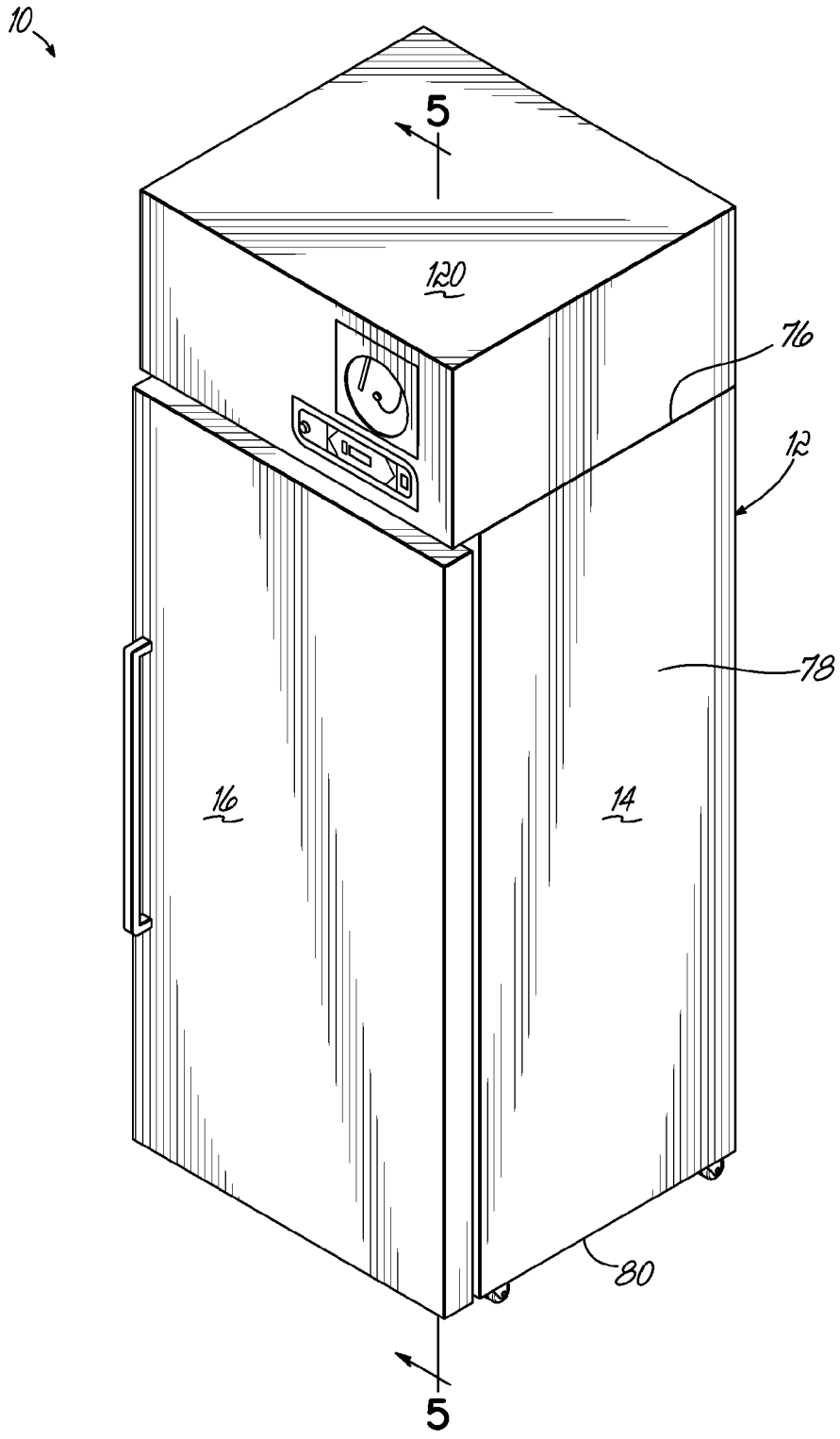
FIG. 1 is a perspective view of a refrigerator including two evaporators with one passively defrosted by sublimation, according to an exemplary embodiment.

With reference to the figures, and more specifically to FIG. 1, an exemplary high performance refrigerator 10 according to one embodiment of the present invention is illustrated. Although the terms "high performance refrigerator" and "refrigerator" are used throughout the specification, it will be understood that the invention encompasses any type of cooling device, including a refrigerator comprising a freezer. The refrigerator of FIG. 1 includes a cabinet 12 for storing items that require cooling to temperatures of about −30° C. or lower, for example. The cabinet 12 includes a cabinet housing 14 defining a generally rectangular cross-section and a door 16 providing access into an interior 18 of the cabinet 12. The cabinet 12 supports one or more components that jointly define a single-stage refrigeration fluid circuit 20 (FIG. 2) that thermally interacts with the air within the cabinet 12 to cool the interior 18 thereof. In this regard, the refrigeration fluid circuit 20 described in further detail below interacts with warmed air in the interior 18 and cools this air to maintain a desired cold temperature in the cabinet 12.

Figure 2:
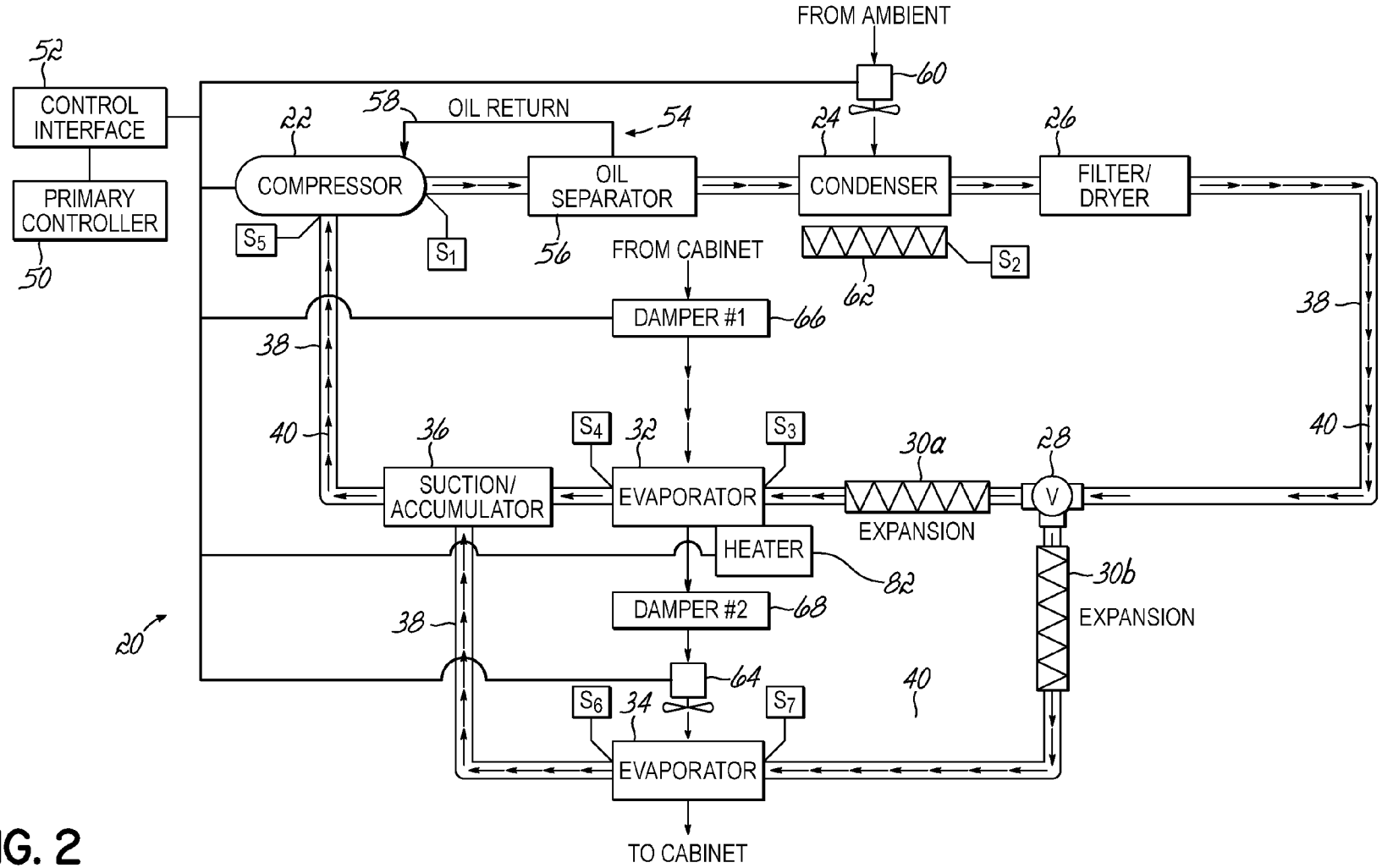
FIG. 2 is a schematic representation of the refrigeration fluid circuit used with the refrigerator of FIG. 1.

With reference to FIG. 2, details of the exemplary refrigeration fluid circuit 20 are illustrated. The refrigeration fluid circuit 20 includes, in sequence, a compressor 22, a condenser 24, a filter/dryer 26, a three-way valve 28, an expansion device 30, a first evaporator 32 and a second evaporator 34 in parallel, and a suction/accumulator 36. Each of these elements of the refrigeration fluid circuit 20 is coupled by piping or tubing 38 configured to circulate the refrigerant 40 passing through the refrigeration fluid circuit 20. A plurality of sensors $S_1$ through $S_7$ are arranged to sense different conditions of the fluid circuit 20 and/or properties of the refrigerant (shown by arrows 40) at various locations within the fluid circuit 20. Each of these sensors $S_1$ through $S_7$ is operatively coupled to a controller 50 accessible through a controller interface 52, which permits controlling of the operation of the fluid circuit 20. It will be appreciated that more or fewer sensors may be provided than the number shown in the exemplary embodiment of the fluid circuit 20.

The refrigeration fluid circuit 20 is configured to circulate the refrigerant 40 between the condenser 24 and the first and second evaporators 32, 34. Generally speaking, heat energy in the refrigerant 40 is transferred to ambient air outside the cabinet 12 at the condenser 24. Heat energy is removed from the interior 18 of the cabinet 12 and transferred to the refrigerant 40 at the first and second evaporators 32, 34. Thus, circulating the refrigerant 40 through the fluid circuit 20 continuously removes heat energy from the interior 18 to maintain a desired internal temperature, such as, for example −30° C.

The refrigerant 40 enters the compressor 22 in a vaporized state and is compressed to a higher pressure and higher temperature gas in the compressor 22. The fluid circuit 20 of this exemplary embodiment also includes an oil loop 54 for lubricating the compressor 22. Specifically, the oil loop 54 includes an oil separator 56 in fluid communication with piping 38 downstream of the compressor 22 and an oil return line 58 directing oil back into the compressor 22. It will be understood that the oil loop 54 may be omitted in some embodiments of the fluid circuit 20.

Upon leaving the compressor 22, the vaporized refrigerant 40 travels to the condenser 24. A fan 60 controlled by the control interface 52 directs ambient air across the condenser 24 and through a filter 62 so as to facilitate the transfer of heat from the refrigerant 40 to the surrounding environment. The air flow through the condenser 24 is shown by arrows in FIG. 2. The refrigerant 40 condenses within the condenser 24 as a result of this heat transfer. The liquid-phase refrigerant 40 then passes through the filter/dryer 26 and the three-way valve 28, then into the expansion device 30. In this embodiment, the expansion device 30 is in the form of a first capillary tube 30*a* leading to the first evaporator 32 and a second capillary tube 30*b* leading to the second evaporator 34, although it is contemplated that it could instead take another form such as, and without limitation, corresponding expansion valves (not shown). Additionally, the expansion device 30 could alternatively be located upstream of the three-way valve 28 in other embodiments within the scope of the invention. The expansion device 30 causes a pressure drop in the refrigerant 40 immediately before the refrigerant 40 enters the first and second evaporators 32, 34.

In each of the first and second evaporators 32, 34, the refrigerant 40 receives heat from the interior 18 through a plurality of evaporator coils (not shown in FIG. 2). An evaporator fan 64 controlled by the control interface 52 forces air flow from the interior 18 of the cabinet 12 through the evaporator coils of the first evaporator 32 when first and second dampers 66, 68 are opened. The first and second dampers 66, 68 are also controlled by the control interface 52. The control of the first and second dampers 66, 68 is further described with reference to FIGS. 7 and 8, below. By virtue of the lowered pressure and the heat transfer from the cabinet 12, the refrigerant 40 vaporizes within the first and second evaporators 32, 34. The vaporized refrigerant 40 is then directed to the suction/accumulator device 36. The suction/accumulator 36 passes the refrigerant 40 in gaseous form to the compressor 22, while also accumulating excessive amounts of the refrigerant 40 in liquid form and feeding it to the compressor 22 at a controlled rate.

The refrigerant 40 used in the refrigeration fluid circuit 20 may be chosen based on several factors, including the expected operating temperature within the cabinet 12 and the boiling point and other characteristics of the refrigerant 40. For example, in refrigerators with an expected cabinet temperature of about −30° C., an exemplary refrigerant 40 suitable for the presently described embodiment includes refrigerants commercially available under the respective designations R404A. Moreover, in specific embodiments, the refrigerant 40 may be combined with an oil to facilitate lubrication of the compressor 22. For example, and without limitation, the refrigerant 40 may be combined with Mobil EAL Arctic 32 oil. It will be understood that the precise arrangement of the components illustrated in the figures is intended to be merely exemplary rather than limiting.

Figure 3:
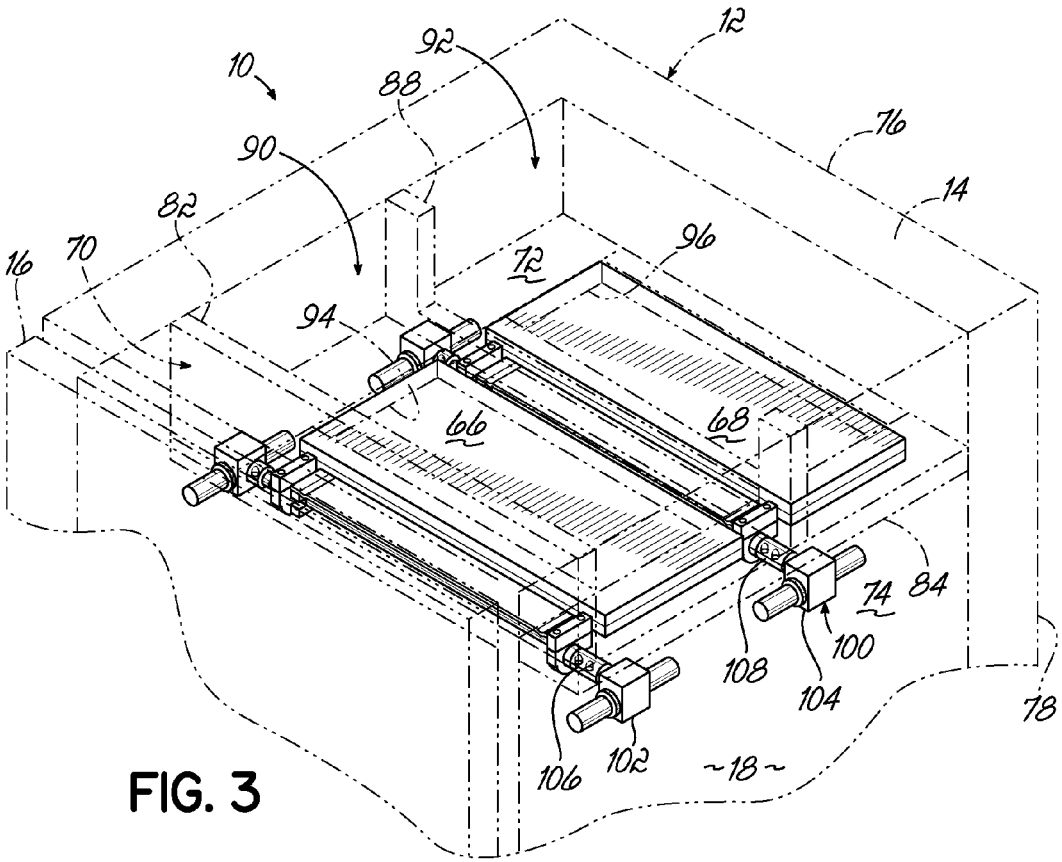
FIG. 3 is a perspective view of the insulating cover (shown in phantom) and dampers used with the refrigerator of FIG. 1.

With reference to FIGS. 3-6 and in particular FIG. 3, the refrigerator 10 includes an insulated cover 70 that divides the interior 18 of the cabinet 12 into a first evaporator compartment 72 and a refrigerated portion 74. The insulated cover 70 is coupled to one or more of the top wall 76, the side walls 78, and/or the bottom wall 80 collectively defining the cabinet housing 14. More particularly, the insulated cover 70 is coupled to the top wall 76 and the side walls 78 (which includes rear wall 78) of the cabinet housing 14 to thermally isolate the evaporator compartment 72 from the heat energy within the interior 18 as that heat energy rises within the interior 18 of the cabinet 12. The insulated cover 70 of the illustrated embodiment includes a vertical panel portion 82 extending downwardly from the top wall 76 of the cabinet housing 14 and a horizontal panel portion 84 extending between the vertical panel portion 82 and the side walls 78 of the cabinet housing 14. The vertical panel portion 82 and the horizontal panel portion 84 are formed from one or more thermally insulating panels, such as the hollow vacuum insulated panel 86 shown in FIG. 3. It will be understood that other types of insulating panels may be used in other embodiments of the invention, including but not limited to foam-based panels.

As shown in FIG. 3, the first evaporator compartment 72 is defined as a generally rectilinear space by the vertical panel portion 82, the horizontal panel portion 84, the side walls 78, and the top wall 76. The first evaporator 32 mounts into a divider panel 88 located generally centrally within the first evaporator compartment 72 so as to divide the first evaporator compartment 72 into an inlet side 90 and an outlet side 92. The divider panel 88 is another vacuum insulated panel or foam-based insulated panel in this embodiment, although it will be understood that other types of dividing panels may also be used in other embodiments. The horizontal panel portion 82 of the insulated cover 70 includes an inlet aperture 94 on the inlet side 90 of the divider panel 88 and an outlet aperture 96 on the outlet side 92 of the divider panel 88. The first damper 66 includes an insulated panel that is operable to rotate to open or close flow through the inlet aperture 94 between the inlet side 90 and the refrigerated interior 18 of the cabinet 12. Similarly, the second damper 68 includes an insulated panel that is operable to rotate to open or close flow through the outlet aperture 96 between the outlet side 92 and the refrigerated interior 18 of the cabinet 12. Thus, the first and second dampers 66, 68 may be operated to enable flow through the evaporator 30.

Also shown in FIG. 3, the first and second dampers 66, 68 are operatively connected to a damper drive mechanism 100 such as respective first and second servo motors 102, 104 and first and second drive shafts 106, 108. The control and operation of the damper drive mechanism 100 is further described in detail with reference to FIG. 7 below. It will be understood that the first and second drive shafts 106, 108 may be connected by a conventional drive linkage (not shown) in some embodiments so that only a single servo motor would be required to open and close the first and second dampers 66, 68. In this regard, the first and second dampers 66, 68 are typically opened (or closed) simultaneously so that flow is enabled through the evaporator compartment 72 and the first evaporator 32.

Figure 4:
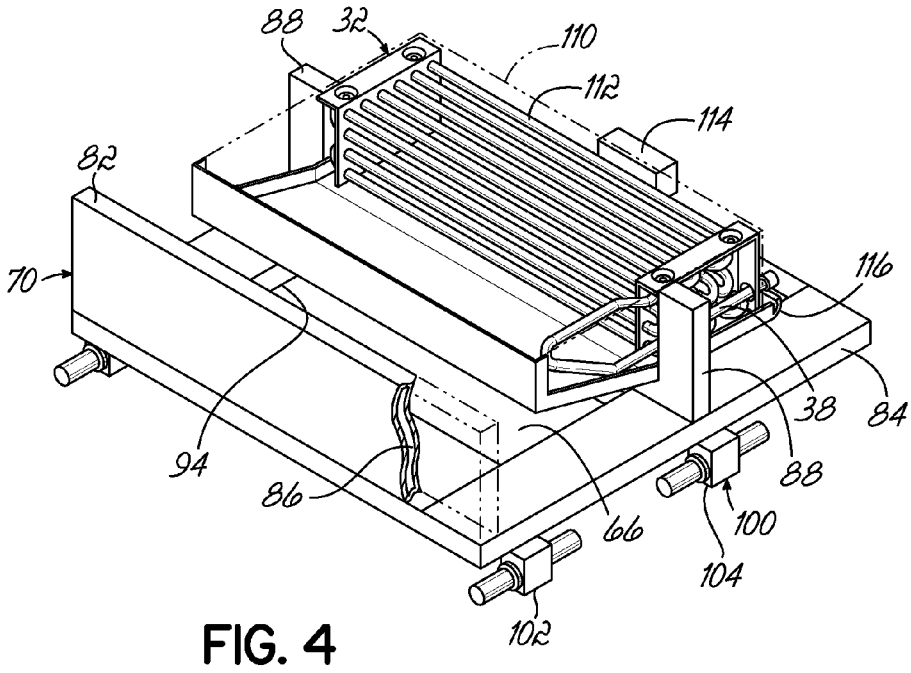
FIG. 4 is a perspective view of the first evaporator used with the refrigerator of FIG. 1, with some of the side panels shown in phantom to reveal interior elements.

Turning to FIG. 4, the first evaporator 32 is shown in further detail. To this end, the first evaporator 32 includes an evaporator housing 110 enclosing a first evaporator coil 112 extending in a serpentine manner across a width of the first evaporator 32. The first evaporator coil 112 is operatively connected to the piping 38 of the refrigeration fluid circuit 20, which carries liquid-phase refrigerant 40 to the first evaporator coil 112 and removes vaporized and any remaining liquid-phase refrigerant from the first evaporator coil 112. The evaporator fan (not shown in FIG. 4) is mounted downstream from the outlet side 92 of the evaporator compartment 72 so as to actuate air flow through the evaporator housing 110 and through the first evaporator coil 112 when the first and second dampers 66, 68 are opened. After flowing through the first evaporator coil 112, cooled air exits the evaporator housing 110 and enters the outlet side 92 of the evaporator compartment 72.

The first evaporator 32 also includes a first defrost heater 114 for removing frost build up on the first evaporator coil 112 as needed or on a regular basis. The first defrost heater 114 is shown mounted adjacent to the first evaporator coil 112 in FIGS. 4 and 5, but it will be appreciated that the first defrost heater 114 may be mounted anywhere within the evaporator housing 110. The first defrost heater 114 is operated by the controller 50 and the control interface 52 previously described with reference to FIG. 2 to heat up the first evaporator coil 112 and melt any frost. The evaporator housing 110 further includes a drip pan 116 located below the first evaporator coil 112 and configured to collect and dispose of melted frost to a location outside the refrigerator 10. In this regard, the drip pan 116 is generally angled from a horizontal orientation so that moisture dripping from the first evaporator coil 112 automatically flows to a moisture outlet (not shown).

Figure 5:
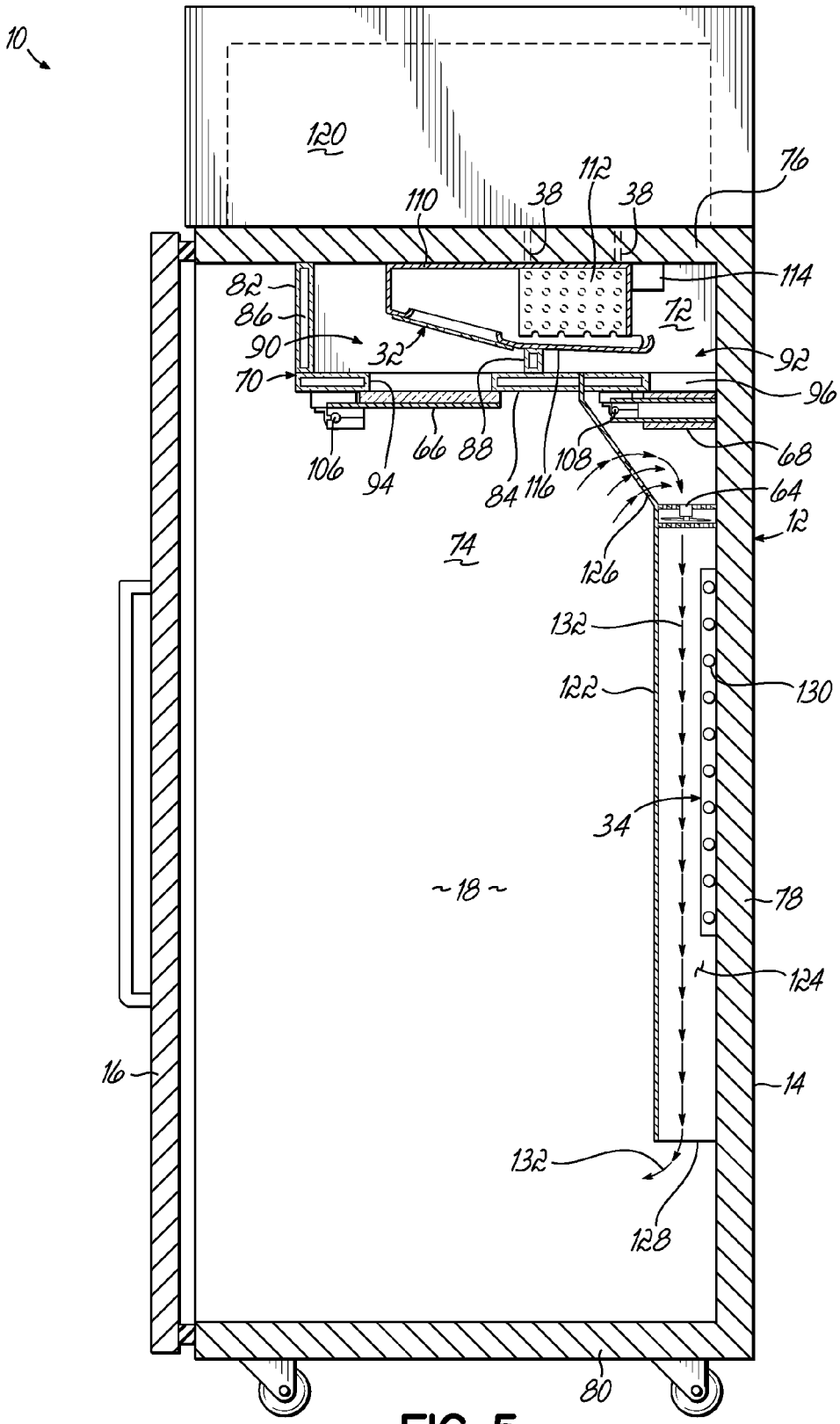
FIG. 5 is a cross-sectional side view of the refrigerator of FIG. 1, with the dampers in a closed position.
Figure 6:
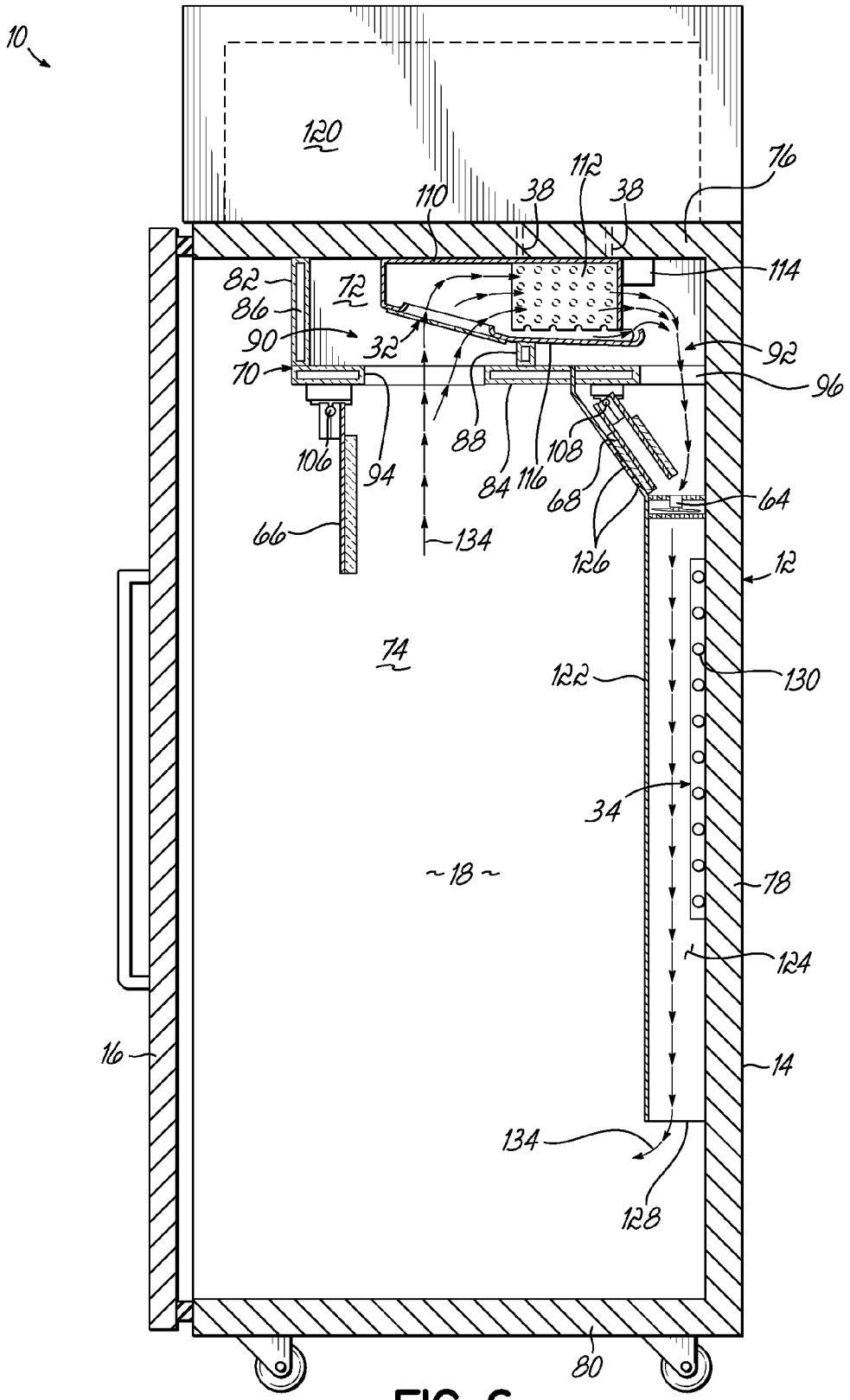
FIG. 6 is a cross-sectional side view of the refrigerator of FIG. 5, with the dampers in an open position.

With reference to FIGS. 5 and 6, the refrigerator 10 further includes an upper compartment 120 located above the top wall 76 of the cabinet housing 14. The upper compartment 120 contains elements of the refrigeration fluid circuit 20 other than the evaporators 32, 34 (e.g., the compressor 22, the condenser 24, etc.), thereby removing most of the space-using or heat generating components from the interior 18 of the cabinet 12. These other elements located within the upper compartment 120 are not shown in FIGS. 5 and 6, although they are schematically shown in FIG. 2. The piping 38 for the refrigerant 40 extends through the top wall 76 to deliver refrigerant between the components in the upper compartment 120 and the first evaporator 32 in the cabinet 12.

The refrigerator 10 also includes an air diffuser 122 extending downwardly from the insulated cover 70 as shown in FIGS. 5 and 6. The air diffuser 122 effectively defines a second evaporator compartment 124 containing the second evaporator 34 and separating the second evaporator 34 from the refrigerated portion 74. The air diffuser 122 includes air inlets 126 located adjacent the insulated cover 70 and an air outlet 128 located near the bottom wall 80 of the cabinet housing 14. In the illustrated embodiment, the second evaporator 34 is a plate-shaped evaporator including a second evaporator coil 130 mounted along the side wall 78 (e.g., the rear wall 78) of the cabinet housing 14. It will be understood that the second evaporator 34 may be a foil-type evaporator or a cold wall tube-type evaporator in various embodiments of the refrigerator 10. Moreover, the second evaporator 34 may be recessed into the foam insulation forming the side wall 78 of the cabinet housing 14 in other embodiments within the scope of the invention.

FIGS. 5 and 6 also illustrate two operating states for the refrigerator 10. More particularly, in FIG. 5 the first and second dampers 66, 68 are closed, which thermally isolates the first evaporator compartment 72 from the refrigerated portion 74. The evaporator fan 64 is positioned downstream of the second damper 68 and within the air diffuser 122 such that the fan 64 continues to operate when the first and second dampers 66, 68 are closed because air can still be circulated through the air diffuser 122 in this operational state. The first defrost heater 114 is only operated in this operational state of the refrigerator 10 so that substantially all of the heat energy generated by the first defrost heater 114 remains within the first evaporator compartment 72 during a defrost cycle or process. To this end, the temperature spike within the refrigerated portion 74 of the interior 18 is reduced or eliminated during the defrost cycle.

In this operating state of FIG. 5, the second evaporator 34 continues to cool the interior 18. The three-way valve 28 directs the refrigerant 40 through the second evaporator coil 130 and air flows through the air diffuser 122 from the air inlets 126 through the second evaporator compartment 124 to the air outlet 128, as indicated by flow arrows 132. This air flow through the second evaporator compartment 124 is enhanced or actuated by operation of the evaporator fan 64. Thus, warm air that rises within the cabinet 12 moves past the second evaporator 34 for cooling before being returned adjacent the bottom of the cabinet 12. It will be understood that the evaporator fan 64 may be located within the first evaporator compartment 72 in alternative embodiments of the invention that are not shown in the Figures, and the evaporator fan 64 would be shut off during defrosting in these alternative embodiments.

In contrast, the first and second dampers 66, 68 are open in FIG. 6 so that air from the refrigerated portion 74 may flow through the first evaporator 32 and the first evaporator coil 112 for cooling. The air flow actuated by the evaporator fan 64 is schematically shown in FIG. 6 by arrows 134. As shown in FIG. 6, the second damper 68 blocks the air inlets 126 of the air diffuser 122, which enables the evaporator fan 64 to draw in warmed air through the first evaporator compartment 72 and then into the second evaporator compartment 124. As a result, the chilled air from the first evaporator compartment 72 flows through the second evaporator compartment 124 and past the second evaporator 34. Thus, relatively warm air enters the evaporator compartment 72 through the inlet aperture 94 and relatively cold air exits the evaporator compartment 72 through the outlet aperture 96 in this operating state of the refrigerator 10. In this operating state of the refrigerator 10, the three-way valve 28 directs the refrigerant 40 to only the first evaporator 32 so that the second evaporator 34 is not actively cooling the chilled air emitting from the first evaporator compartment 72. Furthermore, the relatively cold and dry air sublimates any frost formation on the second evaporator coil 130 so that the second evaporator 34 is passively defrosted continuously during normal operation of the refrigerator 10. The first and second evaporators 32, 34 are only used simultaneously when necessary during initial cooling of the cabinet 12 or right after a door 16 opening, so for the majority of operational time, at least one of the evaporators 32, 34 is being defrosted.

Figure 7:
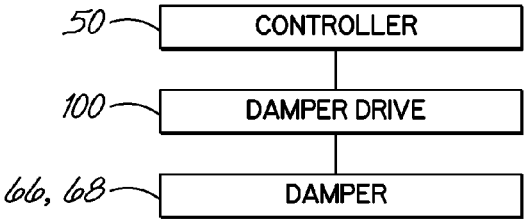
FIG. 7 is a schematic diagram of the controller and damper drive elements used with the refrigerator of FIG. 1.

FIG. 7 schematically illustrates the control and actuation mechanisms for the first and second dampers 66, 68. More specifically, the first and second dampers 66, 68 are connected to the damper drive mechanism 100, which is coupled to the controller 50. As understood in the art, the controller 50 may include at least one central processing unit ("CPU") coupled to a memory. Each CPU is typically implemented in hardware using circuit logic disposed on one or more physical integrated circuit devices or chips. Each CPU may be one or more microprocessors, micro-controllers, field programmable gate arrays, or ASICs, while memory may include random access memory (RAM), dynamic random access memory (DRAM), static random access memory (SRAM), flash memory, and/or another digital storage medium, and also typically implemented using circuit logic disposed on one or more physical integrated circuit devices, or chips. As such, memory may be considered to include memory storage physically located elsewhere in the refrigerator 10, e.g., any cache memory in the at least one CPU, as well as any storage capacity used as a virtual memory, e.g., as stored on a mass storage device such as a hard disk drive, another computing system, a network storage device (e.g., a tape drive), or another network device coupled to the controller 50 through at least one network interface by way of at least one network. The computing system, in specific embodiments, is a computer, computer system, computing device, server, disk array, or programmable device such as a multi-user computer, a single-user computer, a handheld computing device, a networked device (including a computer in a cluster configuration), a mobile telecommunications device, a video game console (or other gaming system), etc. The controller 50 includes at least one serial interface to communicate serially with an external device, such as the damper drive mechanism 100, for example. Thus, the controller 50 functions to actuate operation of the damper drive mechanism 100.

As previously described, the damper drive mechanism 100 may be one or more servo motors 102, 104 connected to the first and second dampers 66, 68 via corresponding drive shafts 106, 108. However, the damper drive mechanism 100 may include other types of actuation mechanisms and devices in other embodiments. For example, the damper drive mechanism 100 may be hydraulically driven, pneumatically driven, or mechanically driven such as by various types of motors. The damper drive mechanism 100 may be configured to rotate the dampers 66, 68 between open and closed positions as shown in the illustrated embodiment, but it will be understood that the damper drive mechanism 100 may alternatively slide or otherwise move the dampers 66, 68 in non-rotational manners as well.

Figure 8:
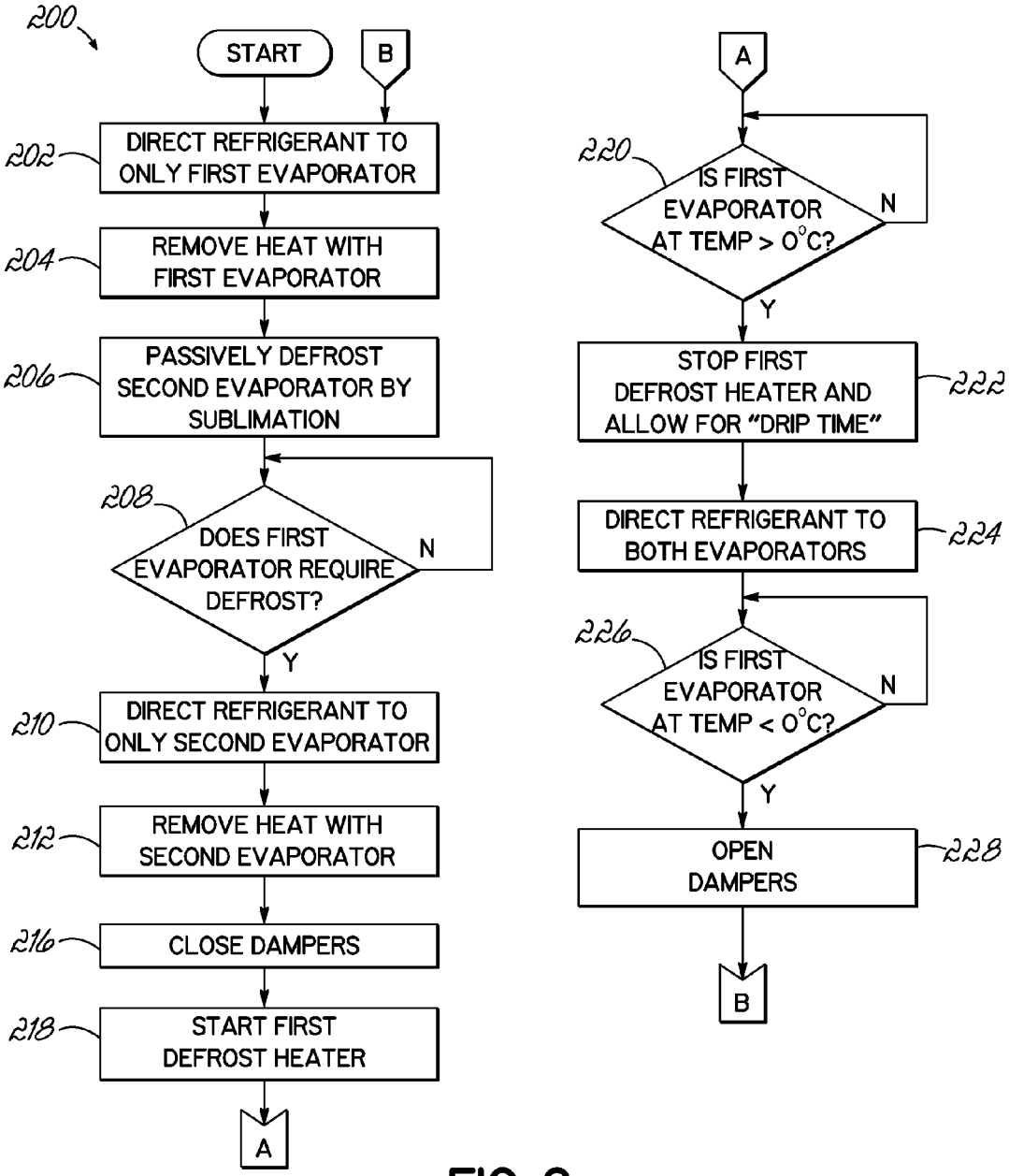
FIG. 8 is a schematic flowchart illustrating an operational sequence of a controller associated with the refrigerator of FIG. 1.

An exemplary operation of the refrigerator 10 is shown schematically in the flowchart of FIG. 8. In this regard, the controller 50 is operable to command the refrigerator 10 to execute the steps of the method 200 shown in that Figure. To this end, the controller during normal operation directs refrigerant 40 with the three-way valve 28 to only the first evaporator 32 at step 202. The first evaporator 32 thus removes heat from the cabinet 12 at step 204. As described briefly above, the chilled air from the first evaporator 32 passes by the inoperative second evaporator 34 and therefore passively defrosts the second evaporator 34 by sublimation at step 206. In this regard, the refrigerator 10 therefore continuously defrosts the second evaporator 34 until the first evaporator 32 requires a defrost cycle. The operational state of the refrigerator 10 at this stage is shown in FIG. 5.

The controller 50 determines whether a defrost cycle is necessary for the first evaporator 32 at step 208. For example, in a time-based defrost cycle, the controller 50 at step 208 determines whether a predetermined amount of time has elapsed since the most recent defrost cycle. If so, then the controller 50 begins the defrost cycle at step 210. If not, then the controller 50 continues to wait and periodically checks to see if the predetermined amount of time has elapsed. In one example, the refrigerator 10 may defrost every six hours, in which case the predetermined amount of time would be six hours. Alternatively, the controller 50 may be operable to perform adaptive defrosts that are spaced by varying amounts of time depending on operational characteristics measured between defrost cycles, as described in further detail below.

Returning to FIG. 8, when a defrost cycle is required to remove frost build up from the first evaporator coil 112, the controller 50 directs refrigerant 40 with the three-way valve 28 to only the second evaporator 34 at step 210. The second evaporator 34 removes heat from the cabinet 12 at step 212. The controller 50 then closes the first and second dampers 66, 68 at step 216 to thermally isolate the first evaporator compartment 72 from the refrigerated portion 74 of the cabinet 12. Thus, both refrigerant flow and air flow have been stopped through the first evaporator 32 after step 216. With the first evaporator compartment 72 thermally isolated from the remainder of the cabinet 12, the controller 50 starts operation of the first defrost heater 114 at step 218. The first defrost heater 114 warms the first evaporator 32 and the first evaporator coil 112 to melt frost and cause the moisture to drip onto the drip pan 116 for removal from the first evaporator 32. The operational state of the refrigerator 10 at this point is shown in FIG. 5.

One of the sensors $S_3$ connected to the first evaporator 32 may be configured to measure the temperature of the first evaporator 32. At step 220, the controller 50 determines whether that sensor $S_3$ is reading a temperature of the first evaporator 32 which is at or exceeding a first target temperature above the freezing point of water (0° C.). In one example, this first target temperature may be about 10° C. If the first evaporator 32 is not at or above that first target temperature, then the controller 50 continues to operate the first defrost heater 114 to remove frost from the first evaporator coil 112. If the first evaporator 32 is at or above the first target temperature, then the controller 50 turns off the first defrost heater 114 and allows a set period of time for additional moisture to drip off the first evaporator coil 112 onto the drip pan 116 at step 222. After this "drip time" has occurred, the controller 50 directs the refrigerant 40 to flow through both evaporators 32, 34 with the three-way valve 28 at step 224, thereby cooling the first evaporator compartment 72.

At step 226, the temperature sensor $S_3$ measures the temperature of the first evaporator 32 and the controller 50 determines whether this temperature is at or below a second target temperature below the freezing point of water (0° C.). In one example, this second target temperature may be about −25° C. If the first evaporator 32 is not at or below the second target temperature, the controller 50 continues to operate the compressor 22 to cool the first evaporator 32. Once the controller 50 determines that the first evaporator 32 is at or below the second target temperature, then the controller 50 opens the first and second dampers 66, 68 at step 228. This enables the evaporator fan 64 to draw air through the first evaporator compartment 72 and through the first evaporator 32 for cooling. This final step of the defrost cycle or method 200 returns the refrigerator 10 to the operational state shown in FIG. 6, which is the normal cooling operational state. The method 200 cycles back to step 202 and the controller 50 continues as described above. As a result of the insulated cover 70, the defrost cycle does not cause a significant temperature spike within the refrigerated interior 18 of the cabinet 12, and the refrigerator 10 therefore is advantageous over conventional refrigerator designs.

Furthermore, the dual evaporator 32, 34 arrangement is also advantageous during initial cool down of the cabinet 12 or immediately after the door 16 is opened. In this regard, the controller 50 is also operable to command the refrigerator 10 to perform an increased cooling cycle in these circumstances. In this increased cooling cycle, the controller 50 directs the three-way valve 28 to direct refrigerant 40 through both of the first and second evaporators 32, 34. The controller 50 also actuates the opening of the first and second dampers 66, 68 such that heat is removed from the refrigerated interior 18 of the cabinet 12 by both evaporators 32, 34 simultaneously. This process advantageously and rapidly returns the refrigerated interior 18 to the intended cold storage temperature when the refrigerator 10 is initially started or immediately after a door 16 opening.

As briefly noted above, in one alternative embodiment the defrost cycle will be an adaptive defrost cycle selectively actuated at step 208 of the method 200. In this adaptive defrost cycle, the period between defrost cycles and the time duration of the defrost cycles are modified based on a plurality of operational parameters monitored by the controller 50. For example, the conventional time-based defrost cycle may operate the first defrost heater 114 for 10 minutes every six hours. By contrast, the adaptive defrost cycle may monitor the actual temperature being maintained in the cabinet 12, as well as the number of door openings and amount of total time the door is open. These and other factors are considered to determine how long the period should be before the next defrost cycle is started, and also how long the first defrost heater 114 should be operated in the next defrost cycle. In this regard, if the door of the cabinet 12 is not opened often during a six hour period and the first evaporator 32 is having little trouble maintaining the desired temperature within the refrigerated portion 74, then the next defrost cycle may be delayed by an additional number of hours and/or shortened in duration. Thus, the adaptive defrost cycle is highly energy efficient because the first evaporator coil 112 is only defrosted when that cycle becomes necessary. Moreover, the adaptive defrost cycle automatically adjusts the refrigerator 10 for proper and efficient operation in a variety of environmental conditions.

While the present invention has been illustrated by a description of an exemplary embodiment and while this embodiment has been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A refrigerator, comprising:

a cabinet having a refrigerated interior;

a refrigeration fluid circuit for circulating a refrigerant, the circuit including a compressor, a condenser, a first evaporator located within the cabinet, a second evaporator located within the cabinet, and a three-way valve enabling selective communication of refrigerant to one or both of the first and second evaporators;

the first evaporator including a first evaporator coil, a first defrost heater, and a first evaporator cover separating a first evaporator compartment from the refrigerated interior, the first evaporator cover defining an inlet aperture communicating between the refrigerated interior and the first evaporator compartment, and an outlet aperture;

the second evaporator including an air diffuser communicating with the first evaporator compartment at the outlet aperture so as to be configured to receive chilled air from the first evaporator compartment and pass the chilled air to the refrigerated interior, the air diffuser defining a second evaporator compartment separated from the refrigerated interior, and the air diffuser including air inlets communicating between the second evaporator compartment and the refrigerated interior, and an air outlet communicating between the refrigerated interior and the second evaporator compartment on an opposite side of the second evaporator from the air inlets;

an evaporator fan producing air flow through at least one of the first and second evaporators;

a first damper located at the inlet aperture and moveable between an open position that permits air flow into the first evaporator from the refrigerated interior, and a closed position that blocks air flow from flowing into the first evaporator via the inlet aperture; and a second damper located at the outlet aperture and moveable between an open position that blocks air flow through the air inlets but permits flow into the second evaporator compartment through the outlet aperture, and a closed position the blocks air flow from flowing out of the first evaporator via the outlet aperture but permits flow from the refrigerated interior through the air inlets into the second evaporator compartment, wherein the three-way valve directs refrigerant into only the first evaporator during normal operation such that chilled air from the first evaporator passively defrosts the second evaporator by sublimation, and wherein the evaporator fan is located in the air diffuser such that when the first and second dampers are open, the evaporator fan draws air flow from the refrigerated interior through the inlet aperture, the first evaporator, the outlet aperture, the second evaporator, and the air outlet in sequence, and such that when the first and second dampers are closed to isolate the first evaporator compartment from the refrigerated interior, the evaporator fan draws air flow from the refrigerated interior through the air inlets, the second evaporator, and the air outlet in sequence.

2. The refrigerator of claim 1, wherein the first evaporator further includes a first defrost heater, and the refrigerator further comprises:

a controller operable to command the refrigerator to perform the following steps when the first evaporator requires defrosting:

direct refrigerant with the three-way valve through only the second evaporator;

remove heat from the refrigerated interior with the second evaporator;

close the first and second dampers to isolate the first evaporator from the refrigerated interior; and start operation of the first defrost heater.

3. The refrigerator of claim 2, further comprising a temperature sensor for detecting the temperature of the first evaporator, and wherein the controller is further operable to command the refrigerator to perform the following steps during defrosting of the first evaporator:

when the temperature sensor detects that the first evaporator has reached a first target temperature above the freezing point of water, stop operation of the first defrost heater and allow for any remaining moisture to drip off the first evaporator coil;

direct refrigerant with the three-way valve into both the first and second evaporators; and when the temperature sensor detects that the first evaporator has reached a second target temperature below the freezing point of water, open the first and second dampers.

4. The refrigerator of claim 3, wherein the controller is further operable to command the refrigerator to perform the following steps during an initial cooling of the refrigerated interior or immediately after the cabinet is opened:

direct refrigerant with the three-way valve through the first and second evaporators; and remove heat from the refrigerated interior with both of the first evaporator and the second evaporator simultaneously.

5. The refrigerator of claim 3, wherein the first target temperature is about 10° C. and the second target temperature is about −25° C.

6. The refrigerator of claim 1, wherein the controller is further operable to command the refrigerator to perform the following steps during an initial cooling of the refrigerated interior or immediately after the cabinet is opened:

direct refrigerant with the three-way valve through the first and second evaporators; and remove heat from the refrigerated interior with both of the first evaporator and the second evaporator simultaneously.

7. The refrigerator of claim 1, wherein the second evaporator is a plate shaped or foil-type evaporator.

8. The refrigerator of claim 1, wherein the second evaporator is a tube-type evaporator including a second evaporator coil.

9. The refrigerator of claim 1, wherein the refrigeration fluid circuit includes an expansion device having at least one of a capillary tube or a valve.

10. The refrigerator of claim 9, wherein the expansion device includes a first capillary tube disposed between the three-way valve and the first evaporator, and a second capillary tube disposed between the three-way valve and the second evaporator.

11. The refrigerator of claim 1, wherein the refrigeration fluid circuit further includes an accumulator operatively connected to the first and second evaporators and the compressor.

12. The refrigerator of claim 1, wherein the refrigeration fluid circuit further includes a filter/dryer operatively connected to the condenser and the expansion device.

13. The refrigerator of claim 1, wherein the first evaporator cover includes a plurality of insulated panels.

14. A method of operating a refrigerator including a cabinet having a refrigerated interior compartment, a refrigeration fluid circuit including a compressor, a condenser, a first evaporator located within the cabinet, a second evaporator located within the cabinet and including an air diffuser, an evaporator fan for drawing air through at least one of the first and second evaporators, and a three-way valve enabling selective communication between the compressor/condenser and one or both of the first and second evaporators, the refrigerator also including at least one damper that may open to permit air circulation from the refrigerated interior through the first evaporator, and the method comprises:

during normal operation, directing refrigerant with the three-way valve only through the first evaporator;

removing heat from the refrigerated interior with the first evaporator; and passively defrosting the second evaporator by sublimation with chilled air directed from the first evaporator through the air diffuser, wherein the first evaporator includes a first evaporator cover separating first evaporator compartment from the refrigerated interior, the first evaporator cover defining an inlet aperture and an outlet aperture, the air diffuser defines a second evaporator compartment separated from the refrigerated interior and includes air inlets and an air outlet, the evaporator fan is located in the air diffuser, and the at least one damper includes a first damper located at the inlet aperture and a second damper located at the outlet aperture, and the method further comprises;

opening the first and second dampers to permit air flow through the inlet and outlet apertures such that the first evaporator compartment communicates with the refrigerated interior and the second evaporator compartment;

blocking air flow through the air inlets with the second damper when the second damper is opened;

drawing air with the evaporator fan from the refrigerated interior through the inlet aperture, the first evaporator, the outlet aperture, the second evaporator, and the air outlet in sequence to cool the refrigerated interior when the first and second dampers are opened;

closing the first and second dampers to isolate the first evaporator compartment from the refrigerated interior by blocking air flow through the inlet and outlet apertures; and drawing air with the evaporator fan from the refrigerated interior through the air inlets, the second evaporator, and the air outlet in sequence to cool the refrigerated interior when the first and second dampers are closed.

15. The method of claim 14, wherein the first evaporator further includes a first defrost heater, and the method further comprises:

when the first evaporator requires defrosting, directing refrigerant with the three-way valve only through the second evaporator;

removing heat from the refrigerated interior with the second evaporator;

closing the first and second dampers to isolate the first evaporator from the refrigerated interior; and starting operation of the first defrost heater.

16. The method of claim 15, further comprising:

when the first evaporator has reached a first target temperature above the freezing point of water, stopping operation of the first defrost heater and allowing for any remaining moisture to drip off the first evaporator coil;

directing refrigerant with the three-way valve into both the first and second evaporators; and when the first evaporator has reached a second target temperature below the freezing point of water, opening the first and second dampers.

17. The method of claim 16, wherein the first target temperature is about 10° C. and the second target temperature is about −25° C.

18. The method of claim 14, further comprising:

during initial cool down of the refrigerated interior or immediately after the cabinet is opened, directing refrigerant with the three-way valve through the first and second evaporators; and removing heat from the refrigerated interior with both the first evaporator and the second evaporator.

* * * * *